US005755586A

United States Patent [19]

Knighton et al.

[11] Patent Number: 5,755,586

[45] Date of Patent: May 26, 1998

[54] PCMCIA STRAIN RELIEVED ELECTRICAL CONNECTOR ASSEMBLY

[75] Inventors: David B. Knighton, Longmont; Kenneth H. Fernalld, Boulder; Harold J. Beecroft, Colorado Springs, all of Colo.

[73] Assignee: Maxtor Corporation, Longmont, Colo.

[21] Appl. No.: 472,533

[22] Filed: Jun. 7, 1995

[51] Int. Cl.[6] ..... H01R 13/62

[52] U.S. Cl. ..... 439/328; 439/59

[58] Field of Search ..... 439/59, 79, 80, 439/328, 637

[56] References Cited

U.S. PATENT DOCUMENTS

| | | | |
|---|---|---|---|
| 3,567,998 | 3/1971 | Ammerman . | |
| 3,803,533 | 4/1974 | Taplin | 439/328 |
| 4,695,108 | 9/1987 | Ichitsubo . | |
| 4,717,218 | 1/1988 | Ratcliff . | |
| 4,781,612 | 11/1988 | Thrush . | |
| 5,020,999 | 6/1991 | Dewitt et al. . | |
| 5,213,515 | 5/1993 | Ishikawa et al. . | |
| 5,230,633 | 7/1993 | Hisatomi et al. . | |
| 5,238,412 | 8/1993 | Morishita et al. . | |
| 5,242,312 | 9/1993 | Tondreault . | |
| 5,269,694 | 12/1993 | Kachlic et al. . | |
| 5,277,596 | 1/1994 | Dixon . | |
| 5,316,489 | 5/1994 | Kachlic et al. . | |
| 5,318,452 | 6/1994 | Brennian, Jr. et al. | 439/79 |
| 5,346,404 | 9/1994 | Shimada . | |
| 5,389,000 | 2/1995 | DiViesti et al. | 439/328 X |
| 5,402,316 | 3/1995 | Volz et al. . | |

*Primary Examiner*—Jes F. Pascua
*Attorney, Agent, or Firm*—Sheridan Ross P.C.

[57] ABSTRACT

A PCMCIA electrical connector for assembly to a printed circuit board is disclosed which includes a C-shaped connector with a strain relief for the contact tails to prevent stress fracturing of soldered connections. The connector is circumjacent the front edge and the side edges of the printed circuit board and snap engages the side edges of the board for precise alignment of the contact tails for soldering to a corresponding conductive pad on a surface of the board. The connector has opposed channel shaped legs which receive the side edges of the circuit board therebetween. The strain relief may include a flex beam formed on one side wall of the channel shaped leg which has a locating pin engaging a corresponding hole in the edge portion of the circuit board.

Alternatively, each channel shaped leg may have a notch in the base of the channel adapted to receive an outwardly projecting tab on each side edge of the printed circuit board. When the electrical connector is utilized in a PCMCIA device having a cover and a base plate, the connector of either embodiment may be further strain relieved by being captured between the cover and the base plate by interlocking tabs on the cover and base plate engaging corresponding recesses in the connector housing. The connector, cover, and base plate are then fastened together to make an integral unit which is entirely strain isolated from the printed circuit board.

2 Claims, 2 Drawing Sheets

PCMCIA STRAIN RELIEVED ELECTRICAL CONNECTOR ASSEMBLY

BACKGROUND OF THE INVENTION

1. Field of the Invention

This invention relates generally to electrical connectors and particularly to a PCMCIA electrical connector of a type circumjacent front and side edges of a printed circuit board.

2. Description of the Related Art

Electrical connectors for printed circuit boards have been known for many years wherein the connectors have terminals with a portion often referred to as a "solder tail" extending rearwardly from a contact in an insulating housing for insertion into holes in a printed circuit board. Miniaturization of such connectors led to the development of surface mount connectors having terminals with solder tails configured for positioning against and connection to conductive pads or circuit traces on the surface of the board. That the solder tails are mounted to a surface of the board is the reason for terming this type of connector "surface mount".

A wide variety of surface mount connectors have been developed, some including socket-type terminals with receptacle contacts for mating with pins of a complementary mating male connector, and others containing terminal pin headers which mount a plurality of terminals with contact pins projecting therefrom for mating with socket-type terminals. Representative surface mount connectors are described in U.S. Pat. Nos. 5,346,404, 5,316,489, 5,269,694, 5,238,412, 5,230,633, 5,213,515, 5,020,999, and 4,717,218.

Typically in a surface mount terminal connector of either the socket or pin header terminal type, the receptacle contacts or contact pins typically project from the connector in spaced apart horizontal rows parallel to the board, whereas all the solder tails are in a single horizontal plane for connection to the planar array of conductive pads on the one side of the board. The solder tails of the terminals are typically arranged in a single row or coplanar rows for automated interconnection to the conductive pads on the circuit board. In fact, automated assembly is a critical design consideration with respect to surface mount connectors. As much of the assembly operation as can be accomplished through the use of robotics is desirable so that manufacturing costs can be kept as low as possible. Two aspects of automated electrical connector assembly are especially relevant, the first relating to the physical placement of the connector in contact with the printed circuit board, and the second relating to the soldering step.

The connector housing is usually mounted to the surface of the printed circuit board in surface mount connectors along with the solder tails. Such surface mounted connector housings do not lend themselves readily to automated alignment and engagement with the circuit board. They therefore usually have to be placed on the board by hand to ensure proper positioning for soldering the leads in place. In this case the connector could become disoriented or fall off the printed circuit board before or during the reflow soldering operation, and especially if the connector and printed circuit board are automatically conveyed to the reflow soldering station.

In reflow soldering, after an appropriate application of solder cream and flux to the conductive pads and physical positioning of the solder tails of the connector thereon, the circuit board is heated, often by means of exposure to radiation in the form of infrared or laser beam energy, to cause a melting or reflow of the solder. The board is then cooled to establish the solder joints between the solder tails and the conductive pads to provide electrical interconnection.

Connectors of the type discussed to this point are used in the manufacture of internal hard disk drive assemblies enclosed in a unitary enclosure having a cover and a base plate. The hard drives include at least one rotating disk carrying a storage medium thereon, means for rotating the disk, and an movable actuator arm carrying a read/write head for retrieving and/or recording information on the storage medium. In addition, a printed circuit board containing the control circuitry is often mounted in the enclosure. The disk spindle motor and actuator are most often mounted to the base plate and electrically connected to the printed circuit board which in turn is electrically connected via a surface mount electrical connector in the manner above described for external interface to the central processing unit of a computer. The cover, together with the base plate, defines an environmental enclosure for the disk drive.

Developments in personal, portable, and laptop computers have prompted reductions in the size and increases in memory capacity of hard disk drives which heretofore were invisible to the end user. As portability has become a more important consideration, an industrial dimensional and interface standard for removable components of a computer system was developed. This standard is known as the Personal Computer Memory Card International Association (PCMCIA) standard. PCMCIA memory cards, which include miniature hard disk drives, are themselves portable, interchangeable between computers, and can be removed and reinserted by the end user on a regular basis. Therefore PCMCIA disk drives need a robustness that heretofore has not been required.

Conventional PCMCIA connectors now in use in these miniature hard disk drive assemblies are fastened to the associated printed circuit board in the assembly solely by the solder tails of the connector soldered to the termination pads of the printed circuit board. The printed circuit board is, in turn, fastened to the base pate of the hard disk drive enclosure. Since these PCMCIA dimensioned connector assemblies are repeatedly connected and disconnected from the host computer, this regular handling creates frequent flexure of these solder joints. This lead flexure can result in cracking of the solder joints and ultimately result in connection failure. The result of such failures is a useless component such as a memory card or hard disk drive.

Lead flexure is not a new problem. The above-referenced United States Patents typify solutions to the problem of lead flexure with respect to surface mount connectors While numerous attempts to address lead flexure in electrical connectors in general have been made, the existing solutions relate to connectors having housings which themselves are fastened to the surface of the printed circuit board. With such a mounting, external forces on the connector, torsional or otherwise, will be transferred directly to the solder joints.

The problem of lead flexure is especially acute with respect to PCMCIA devices, i.e. devices in compliance with the PCMCIA standards as the conventional PCMCIA connector is supported entirely by the electrical solder joints between the connector solder tails and the conductive pads on the printed circuit board. As previously mentioned, the solder joints are repeatedly strained by the coupling and uncoupling of the mating connectors, bringing about connection failure. There is therefore a need for an electrical connector assembly for use in PCMCIA standard applications, wherein the connector housing can engage a printed circuit board and can be retained on the circuit board before and during reflow soldering, thereby reducing manufacturing costs. There is also a need for the connector to engage the circuit board in such a way that any force applied to the connector which is not isolated is strain relieved to the printed circuit board and not to the solder joints. Finally, there is also a need for a connector mounting design which also isolates the connector from transmitting externally applied forces to the printed circuit board.

SUMMARY OF THE INVENTION

The present invention is directed particularly to an electrical connector assembly that satisfies these needs and in particular to connectors in compliance with the PCMCIA dimensional standards. The electrical connector assembly in accordance with the present invention comprises a printed circuit board, and a complementary C-shaped edge connector. The printed circuit board has a planar surface, a front edge between a pair of rearwardly extending side edges, and a plurality of conductive pads aligned on the planar surface adjacent the front edge. The C-shaped connector has an insulating housing which itself includes front and rear surfaces and an elongated central portion having front and rear surfaces between a pair of rearwardly extending legs which extend generally perpendicular to the central portion. The elongated central portion comprises a plurality of transverse through bores between the front and rear surfaces, with each through bore being adapted to receive an electrical contact therein.

Each contact has a first portion proximate the front surface adapted to receive a complementary contact of a mating connector, and a second tail portion rearwardly extending beyond the rear surface of the connector, and spaced corresponding to a unique one of the conductive pads on the printed circuit board. Electrical connection between the tail portions and the conductive pads is made by one of several well known techniques, such as reflow soldering, which produces a solid mechanical and electrical interconnection therebetween, which in the case of reflow soldering would be a solder joint.

The C-shaped edge connector of the present invention is circumjacent the front edge and the side edges of the printed circuit board. The legs of the housing include strain relief means to redirect and therefore relieve strain on the electrical interconnection between each contact tail and conductive pad.

Two embodiments of this strain relief means are described herein. In each embodiment, the connector legs snap engage complementary features on the printed circuit board to relieve strain during connection and disconnection of the connector by the user.

In a first embodiment of the C-shaped connector in accordance with the present invention, each leg has a channel shape for receiving a side edge of the printed circuit board therein adjacent the front edge of the printed circuit board. The channel shaped leg has side walls forming an upper flex beam and a lower fixed surface beam defining an aligning slot therebetween adapted to receive the side edge of the printed circuit board. The upper flex beam is resiliently cantilever supported by the leg and has a first surface to which is integrally molded a downwardly protruding locating pin. This locating pin is biased by the flex beam to snap engage into a hole in the printed circuit board adjacent the side edge only when the board is fully inserted into the connector. The upper flex beam provides a biasing force on the locating pin normally toward the opposing surface of the lower fixed surface beam. As the circuit board is inserted into the connector, the locating pins on the flex beams on each leg are deflected by the opposite side edges of the board until the locating pins are snap engaged in the holes at full insertion. Following assembly of the connector to the printed circuit board, any strain placed on the connector will be directly transferred to the printed circuit board via the locating pins, rather than via the solder tails and the solder connections.

In a second embodiment of the present invention, each channel shaped leg has a base and generally parallel side walls defining an aligning slot therebetween for receiving one of the side edges of the printed circuit board therein. The surface of the base in the aligning slot has a notch therein. Each aligning slot includes a side wall with a notch therein. Each side edge of the printed circuit board has an outwardly projecting rounded tab positioned and dimensioned corresponding to the notch in the aligning slot such that the tab is snap engaged with its corresponding notch when the side edges of the printed circuit board are fully inserted between the legs in the aligning slots of the connector. In this embodiment of the invention, as the printed circuit board is inserted into the aligning slots of the legs of the connector, the central portion of the connector resiliently deflects to permit passage of the tabs on the edges of the board along the base in the aligning slots of the connector legs until the notches are reached, at which time the protuberances and notches snap engage in the fully assembled position. As in the first embodiment, strain applied to the connector is diverted from the solder tails to the printed circuit board directly by the Both of the above embodiments further include interlocking means for capturing the connector between the cover and the base plate of the enclosure which houses the entire hard disk drive assembly and printed circuit board. This capturing means includes an elongated tab projecting forwardly from each corner of the front edge of the cover and an elongated tab projecting forwardly from each corner of the front edge of the base plate. Each tab has an enlarged cylindrical boss which is received in a correspondingly shaped recess in the top and bottom surface of a front portion of each leg of the connector. Therefore the elongated tab at one front corner of the cover and the bosses of the elongated tab at the corresponding corner of the base interlock with the recesses in the connector to interlock the connector and enclosure together. Standard fastening means such as a screw or bolt and nut are then used to fasten the bosses to the legs of the C-shaped connector.

It is an object, therefore, of the present invention to provide a new and improved electrical connector assembly wherein the connector is circumjacent and snap engages edges of a printed circuit board.

Another object of the invention is to provide a PCMCIA connector having means for relieving strain on the solder tail/terminal pad joints from external forces on the connector.

A further object is to provide a connector used in a PCMCIA device such as a hard disk drive assembly having an enclosure which includes a cover and a base plate with means for capturing the connector therebetween, thereby isolating the solder tail/terminal pad joints from external forces on the connector.

Still another object of the invention is to provide a strain relief connection between a printed circuit board and the connector which permits automated solder tail alignment and engagement of the printed circuit board by the connector in the proper position for subsequent reflow soldering.

A still further object of the invention is to provide strain relief means wherein the connector is retained on the circuit board before and during reflow soldering.

Other objects, features and advantages of the invention will be apparent from the following detailed description when taken in connection with the accompanying drawings.

DETAILED DESCRIPTION OF THE INVENTION

Figure 1:
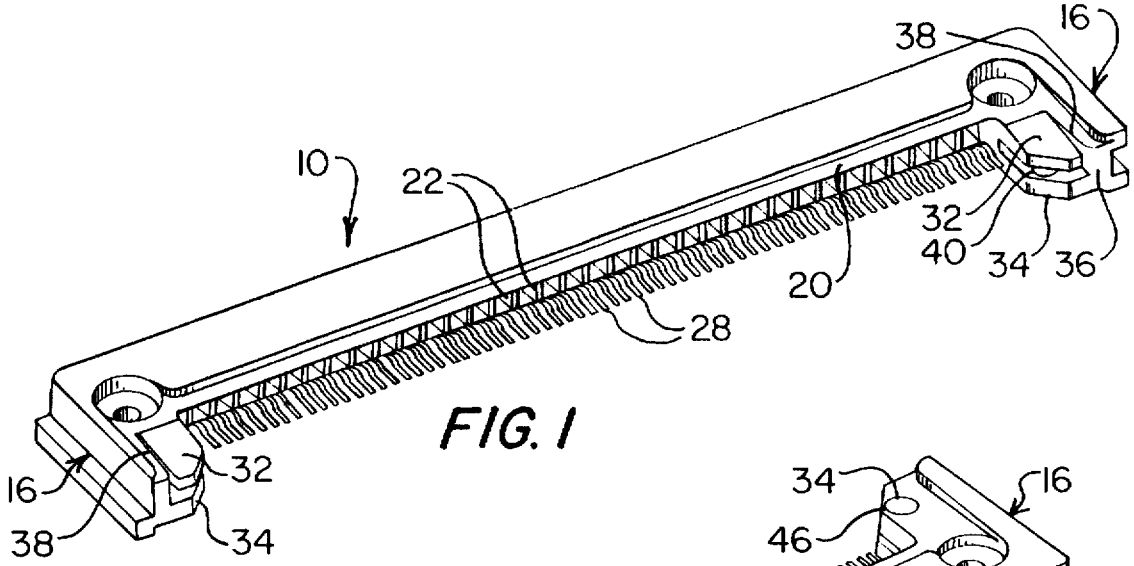
FIG. 1 is a perspective rear view of a first embodiment of the electrical connector assembly in accordance with the invention prior to assembly to a printed circuit board.
Figure 2:
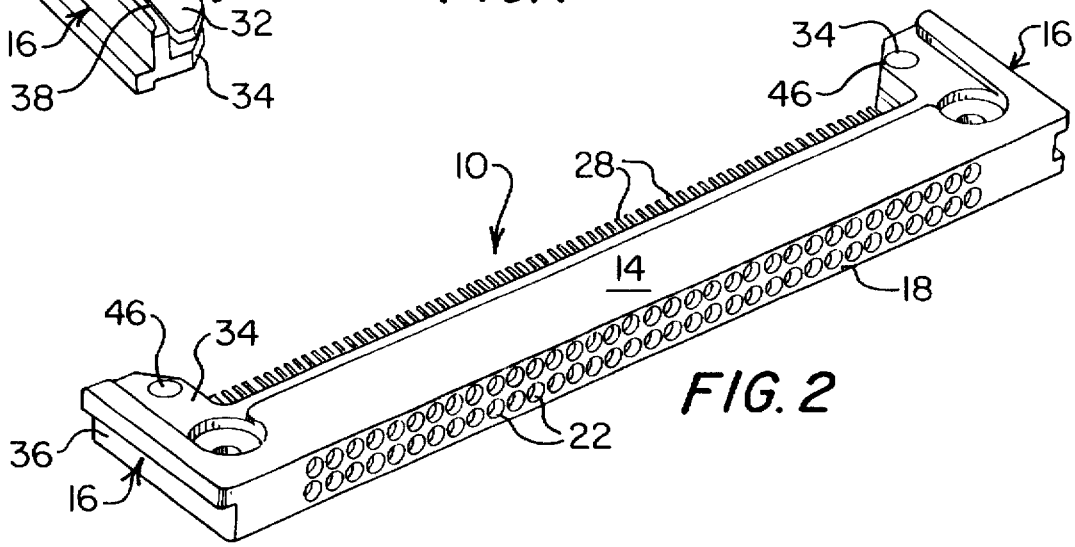
FIG. 2 is a front perspective view of the connector shown in FIG. 1.
Figure 3:
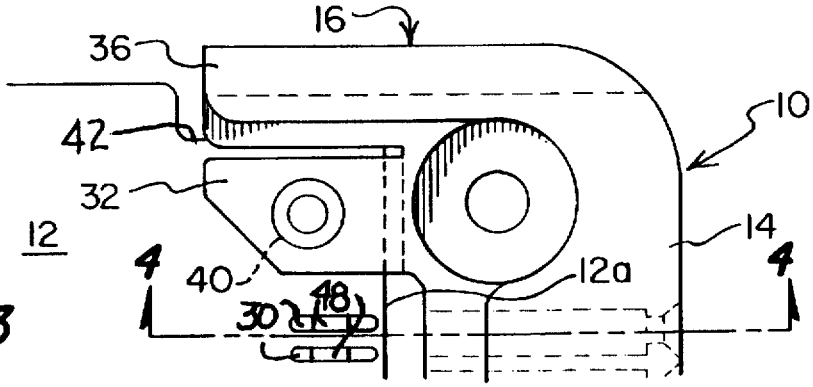
FIG. 3 is an enlarged partial top plan view of the first embodiment of the invention, including a circuit board snap engaged in the connector.

Referring now to the drawing, a PCMCIA connector 10 in accordance with a first embodiment of the invention is shown in FIGS. 1 through 3 for installation on an end of a circuit board 12. Referring particularly to the rear perspective view of FIG. 1, the connector 10 comprises a C-shaped insulating housing having an elongated central portion 14 between a pair of short, rearwardly extending and opposing channel shaped legs 16. The central portion 14 has a generally rectangular cross section and further includes a front face 18 and a rear face 20. A plurality of transverse through bores 22 passing through the central portion 14 between the front face 18 and rear face 20 are arranged in two rows generally parallel to each other and to the circuit board 12 to which the connector 10 is connected.

Figure 4:
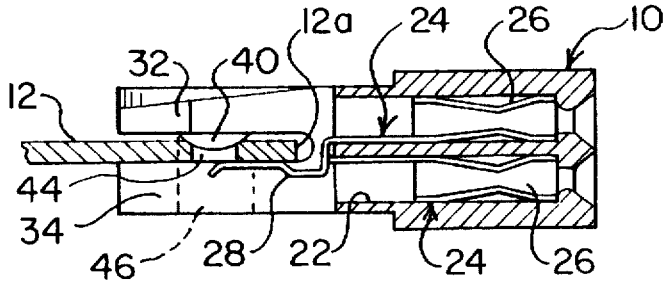
FIG. 4 is a sectional view taken generally along line 4—4 of FIG. 3.

As shown in FIGS. 1, 2 and 4, each through bores 22 carries an electrical contact 24 of a conventional type having a front receptacle portion 26 proximate the front face 18 adapted to receive a pin contact of a mating connector (not shown), and a tail portion 28 extending rearwardly beyond the rear face 20 of the central portion 14 of the connector housing. The tail portions 28 are arranged in a single planar row for surface engagement between each tail portion 28 and a corresponding conductive solder pad 30 in a row arranged adjacent the front edge 12*a* of the printed circuit board 12.

After assembly of the connector 10 to the circuit board 12 in accordance with one aspect of the invention as will subsequently be described, the tail portions 28 of the contacts 24 are electrically and mechanically joined to the solder pads 30. The connection is typically made by application of an appropriate solder cream and flux to the pads 30 and the tail portions 28 and then exposing the connections to sufficient heat energy to cause a melting or reflow of the solder. The connections are then cooled to solidify the joints. As the tail portions 28 and the solder pads 30 are extremely close together, on the order of 68 connections within a space of about 43 millimeters, proper positioning of the connector on the circuit board is critical to the formation of separate individual connections.

The connector 10 in accordance with the present invention is preferably a molded plastic body which also includes a strain relief means for reducing strain on the solder connections between the pads 30 and the contact tail portions 28. This strain relief means also provides accurate positioning of the connector on the printed circuit board 12 in preparation for soldering the tails 28 to the pads 30 as above described. Referring again to FIGS. 1–3, each of the short, channel shaped legs 16 of the connector 10 has a pair of side walls 32 and 34 spaced apart by a common integral base portion 36. The side walls 32 and 34 and the base portion 36 integrally join with the central portion 14 of the connector 10.

The upper side wall 32 has a longitudinal slit 38 therethrough separating the side wall 32 from the base portion 36 of the leg 16. The side wall 32 therefore forms a flex beam cantilever supported from the portion of the leg 16 merging with the central portion 14. The side wall 32 is resiliently biased toward the opposing side wall 34 and has a locating pin member 40 protruding from an inside surface of the flex beam side wall 32 toward the opposing side wall 34. This locating pin member 40 is integrally molded into the inside surface of the side wall 32 and preferably has a rounded, partial ball shape. The pin 40 may alternatively have a wedge shape or a generally conical or truncated conical shape, depending on the degree of interlocking desired between the circuit board 12 and the connector 10.

The lower or opposite side wall 34 is a rigid wall, being joined at its forward end to the central portion 14 and at its base to the base portion 36 of the leg 16. Each of the legs 16 has the same side wall structure. The slit 38 may be made in either of the upper or lower side walls 32 or 34. In the embodiment shown, the slit is in the upper side wall 32. In either case, however, the locating pin would be positioned on the side wall forming the flex beam. The channel shaped legs 16 are each designed to sandwich a front portion of one of the side edges of the printed circuit board 12 so that the front portion of the board is rigidly held in place between the opposing legs 16.

The printed circuit board 12 to which the connector 10 is joined has a generally planar surface and rearwardly extending side edges 42 from the front edge 12*a*. The printed circuit board has a pair of holes 44 therethrough which are spaced from the front edge 12*a* and each is adjacent one of the side edges 42. Each of the holes 44 is positioned at a location along the side edge 42 which corresponds to the position of the locating pin members 40 when the each of the side edges 42 of the printed circuit board 12 is inserted fully and sandwiched between the side walls 32 and 34 of one of the channel shaped legs 16 as is shown in the partial plan view of the assembled connector assembly in FIG. 4. In this position, the locating pins 40 snap into the holes 44 and therefore hold the connector 10 in position with respect to the tail portions 28 and the solder pads 30 on the circuit board 12.

The lower side wall 34 may also have a hole 46 therethrough positioned opposite the locating pin 40 to accommodate local flexure of the printed circuit board 12 beneath the locating pin 40 when the board 12 is fully inserted. In addition, any strain on the connector 10 itself will be transmitted not to the contact tail portions 28 and the solder connections, but to the circuit board 12 itself via the locating pins 44 and the flex beam side wall 32 and side wall 34 sandwiching and holding the side edges 42 of the circuit board 12 in position.

The upper side wall flex beam 32 provides a biasing force on the locating pin 40 normally toward the opposing surface of the side wall 34 such that the locating pin 40 resiliently engages the hole 44 when the printed circuit board 12 is fully inserted into the channel shaped legs 16 of the connector 10. This feature also provides a physical feedback signal during assembly such that full insertion and correct positioning of the circuit board 12 may be readily sensed either manually or automatically as the locating pins 40 snap into place.

Figure 5:
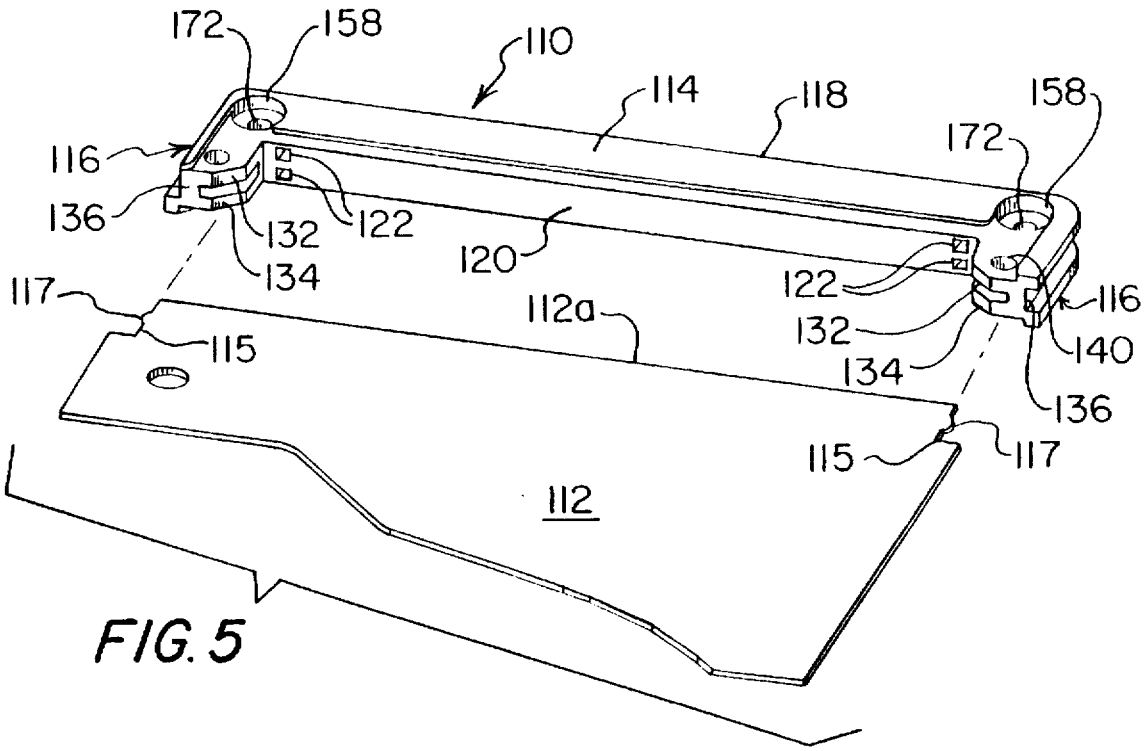
FIG. 5 is an exploded perspective view of a second embodiment of the electrical connector assembly in accordance with the invention.
Figure 7:
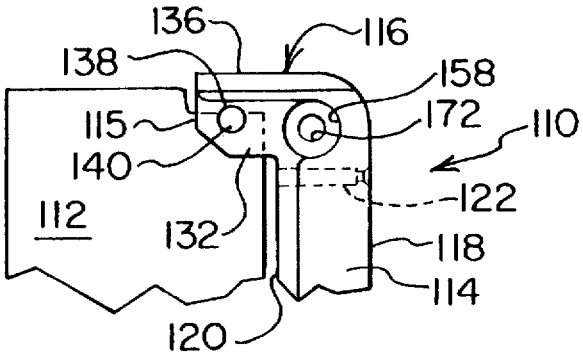
FIG. 7 is a partial top plan view of the assembled connector and circuit board shown in FIG. 5.

An electrical connector 110 in accordance with a second embodiment of the present invention is illustrated in FIGS. 5 and 7. The connector 110 is similar in construction to the first embodiment 10 described above except for the strain relieving means. The connector 110 in combination with the printed circuit board 112 forms a connector assembly as shown in the exploded view of FIG. 5. The connector 110 comprises a C-shaped insulating housing having an elongated central portion 114 between a pair of short, rearwardly extending and opposing channel shaped legs 116. The central portion 114 has a generally rectangular cross section and further includes a front face 118 and a rear face 120. A plurality of transverse through bores 122 passing through the central portion 114 between the front face 118 and rear face 120 are arranged in two rows generally parallel to each other and to the circuit board 112 to which the connector 110 is connected.

Each through bore 122 carries an electrical contact 24 as is shown in FIGS. 1 through 4. Note that in FIGS. 5 and 7, these contacts have been omitted for clarity. In addition, only two vertical sets of through bores 122 are shown. It is to be understood that these are simply representative of the row of through bores 122 contained in the central portion 114 of the connector 110 as is shown in the first embodiment in FIGS. 1 through 3. As in the first embodiment of the invention, the contacts are of a conventional type having a front receptacle portion adapted to receive a pin contact of a mating connector and a tail portion extending rearwardly beyond the rear face 120 of the central portion 114. The tail portions are arranged in a single planar row for surface engagement between each tail portion and a corresponding conductive solder pad (not shown) in a row of pads arranged adjacent the front edge 112*a* of the printed circuit board 112.

The printed circuit board 112 has a planar surface and a front portion having a front edge 112*a* and side edges 115 which may or may not be recessed as shown in FIGS. 5 and 7 to accomodate the channel shaped legs 116 to present a flush side connection as in FIG. 7. These side edges 115 have outwardly protruding tabs 117 and are designed to be inserted in the channel shaped legs 116.

Each of the short, channel shaped legs 116 of the connector 110 has a pair of side walls 132 and 134 spaced apart by a common integral base portion 136. The side walls 132 and 134 and the base portion 136 integrally join with and are supported by the central portion 114 of the connector 110. The pair of spaced side walls 132 and 134 and the base portion 136 form a rigid slot for receiving the side edge 115 of the printed circuit board 112 therein. Each of the base portions 136 has a notch 138 formed in an inside surface thereof which is shaped complementary to the outwardly projecting tab 117 on the side edge 115 of the circuit board 112. The notch 138 is preferably arcuate and is simply an arcuate segment of a transverse circular through hole 140 passing transversely through both of the side walls 132 and 134 and part of the base portion 136 thus carving out part of the inner surface of the base portion 136. This notch 138 is located along the inner surface of the base portion 136 of the leg 116 at a position corresponding to the location of the tab 117 on the side edge 115 when the circuit board 112 is fully inserted into and in between the channel shaped legs 116. In this second embodiment, the central portion 114 flexes to permit the legs 116 to separate to permit the side tabs 117 on the edges 115 of the circuit board 112 to pass into the channels. When the printed circuit board 112 is fully inserted, the tabs 117 snap engage the notches 138 to hold the circuit board 112 in place for soldering the tail portions of the contacts to the solder pads on the circuit board as in the first embodiment. This arrangement also relieves strain on the tail portions directly to the circuit board 112.

Figure 6:
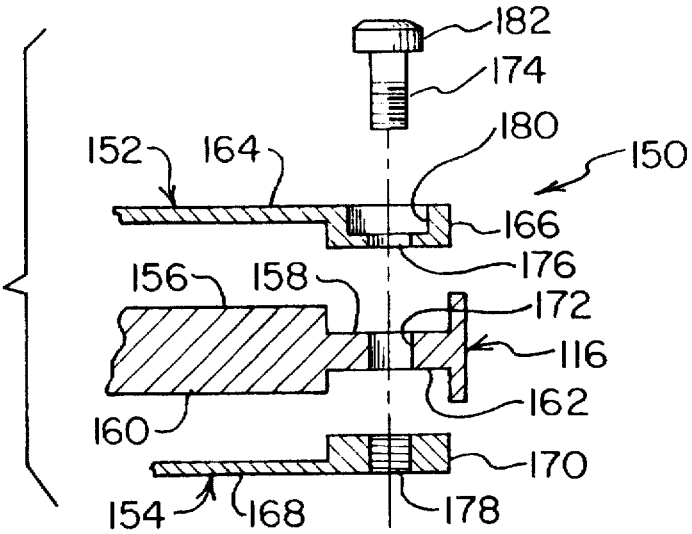
FIG. 6 is a an exploded sectional view through one corner of the assembled enclosure comprising the cover, the PCMCIA connector, and base plate in accordance with the invention.

Referring now to FIG. 6, the connectors 10 and 110 are preferably part of a generally rectangular enclosure 150 for a memory device such as a hard disk drive assembly or a memory card contained on the printed circuit board 12 or 112. The enclosure 150 is not shown in FIGS. 1 through 5 and 7 as it would hide most of the elements of the connectors previously described. The enclosure 150 includes a cover 152 and a base plate 154 which, when fastened together with either one of the connectors 10 or 110, provides an environmental barrier to dirt and moisture entry into the enclosed components. FIG. 6 shows an exploded sectional view of one front corner of an enclosure 150 in accordance with this aspect of the invention which includes capturing means for interlocking either of the connectors 10 or 110 to the cover 152 and the base plate 154 of the enclosure 150 for isolating external forces on the connector from the solder joint connections to the circuit board 12 or 112.

The capturing means will be described with reference to connector 110. However, it is to be understood that connector 10 also has the same capturing features as does connector 110. Each leg 116 of the connector 110 has an upper surface 156 having a preferably cylindrical recess 158 therein and a lower surface 160 having a preferably cylindrical recess 162 therein opposite the recess 158 in the upper surface 156. The cover 152 has a first pair of tabs 164 extending from opposite ends of a front edge thereof, one of which is shown in FIG. 6. Each tab 164 has an enlarged protruding portion, preferably in the form of a cylindrical boss 166 sized complementary to the recess 158 in the upper surface 156 of the leg 116. The base plate 154 has a second pair of tabs 168 extending from opposite ends of a front edge thereof, one of which is shown in FIG. 6. Each tab 168 has an enlarged protruding portion, preferably in the form of a cylindrical boss 170 sized complementary to the cylindrical recess 162 in the lower surface 160 of the leg 116. The recesses 158 and 162 are joined by a coaxial bore 172 through each leg 116.

The protruding portions or bosses 166 and 170 of the tabs 164 and 168 engage the connector 116 in the recesses 158 and 162 to interlock the cover 152 and the base plate 154 to the connector 110. The tabs 164 and 168 are fastened together, sandwiching the connector 110 therebetween by a screw 174 extending through an axial bore 176 through the upper cylindrical boss 166, through the coaxial bore 172, and into a threaded bore 178 in the cylindrical boss 170. The upper boss 166 preferably has a coaxial counterbore 180 therein having a diameter larger than the axial bore 176 to accommodate the head 182 of the screw 174.

While the invention has been described above with reference to particular embodiments thereof, It will be understood that the present invention may be practiced otherwise than as specifically disclosed without departing from the spirit or central characteristics thereof. For example, the bosses 166 and 170 may have a shape other than cylindrical. A bolt and complementary nut or a rivet may be substituted for the screw 174 or may not be required if the cover 152 and base plate 154 are fastened together by other means. In the first embodiment, the cantilever beam may be formed of side wall 34 rather than of side wall 32. Also, the snap engaging tab and notch arrangement of the second embodiment may be combined with the flex beam and locating pin arrangement of the first embodiment to produce a combination embodiment of the connector assembly in accordance with the present invention. Finally, each of the embodiments may include the capturing means set forth above. Thus the present examples and embodiments, therefore, are to be considered in all respects as illustrative and not restrictive, and the invention is not to be limited to the details given herein. All patents, patent applications, and publications referred to herein are hereby incorporated by reference in their entirety.

What is claimed is:

1. An electrical connector assembly comprising:

a printed circuit board having a planar surface and a front portion having a front edge between a pair of rearwardly extending side edges, and a plurality of conductive pads aligned on said planar surface adjacent said front edge;

a C-shaped connector having an insulating housing including an elongated central portion between a pair of rearwardly extending opposing channel shaped legs receiving said front portion of said printed circuit board therebetween, said elongated central portion comprising a plurality of transverse through bores each carrying an electrical contact therein, each said contact having a front portion adapted to receive a complementary contact of a mating connector and a tail portion rearwardly extending out of said housing connected to a unique one of said conductive pads on said printed circuit board, said circuit board having portions of said side edges received within said channel shaped legs, wherein each of said channel shaped legs has a pair of side walls spaced apart by an integral base portion, each of said side walls sandwiching a portion of one of said side edges therebetween; and strain relief means on said channel shaped legs for engaging said printed circuit board along said side edges to relieve strain between said tail portions of said contacts and said corresponding conductive pads, wherein said strain relief means comprises each of said base portions of said channel shaped legs having a notch in an inside surface of said base portion in between said side walls and each of said side edges of said circuit board has an outwardly projecting tab spaced from said front edge, said tab having a shape complementary to said notch in said base portion of said channel shaped leg of said connector, said tabs snap engaging said notches to provide strain relief to said tail portions of said contacts when said portions of said side edges of said printed circuit board are fully inserted into said channel shaped legs of said connector, wherein said notch has an arcuate shape defined by an arcuate segment of a circular through hole transversely passing through said side walls and a portion of said base portion.

2. An electrical connector assembly for a memory device contained in an enclosure having a cover and a base plate, said electrical connector assembly comprising:

a printed circuit board having a planar surface and a front portion having a front edge between a pair of rearwardly extending side edges, and a plurality of conductive pads aligned on said planar surface adjacent said front edge;

a C-shaped connector housing including an elongated central portion between a pair of rearwardly extending opposing channel shaped legs, said elongated central portion comprising a plurality of transverse through bores, each said through bore receiving an electrical contact therein, each said contact having a front portion adapted to receive a complementary contact of a mating connector, and a tail portion rearwardly extending out of said housing and electrically connected to a unique one of said conductive pads, wherein each of said channel shaped legs has a pair of side walls spaced apart by an integral base portion, each of said side walls sandwiching a portion of one of said side edges therebetween;

strain relief means on said channel shaped legs for engaging said printed circuit board along portions of said side edges to relieve strain between said tail portions of said contacts and said corresponding conductive pads, wherein said strain relief means comprises each of said base portions of said channel shaped legs having a notch in an inside surface of said base portion in between said side walls and each of said side edges of said circuit board has an outwardly projecting tab spaced from said front edge, said tab having a shape complementary to said notch in said base portion of said channel shaped leg of said connector, said tabs snap engaging said notches to provide strain relief to said tail portions of said contacts when said portions of said side edges of said printed circuit board are fully inserted into said channel shared legs of said connector, wherein said notch has an arcuate shape defined by an arcuate segment of a circular through hole transversely through said side walls and a portion of said base portion; and capturing means for interlocking said connector housing together between said cover and said base plate so that external forces on said connector are isolated from said printed circuit board contained within said enclosure, said capturing means comprising:

a first pair of tabs extending forwardly from opposite ends of a front edge of said cover, each over one of said opposing legs of said connector, a second pair of tabs extending forwardly from opposite ends of a front edge of said base plate under said opposing legs of said connector, each of said tabs having an enlarged protruding portion;

each of said legs having upper and lower surfaces and a recess shaped complementary to said protruding portions of said tabs in each of said surfaces, each of said legs having a through bore joining said recesses, and fastening means extending through said through bore for joining said tabs and said connector housing together whereby said protruding portions and said recesses cooperate to interlock said connector to said cover and base plate of said enclosure, wherein said fastening means comprises each of said protruding portions of said tabs on said cover having a partial bore of a first diameter and a coaxial bore having a smaller diameter than said first diameter and forming a bearing surface therebetween, said partial bore dimensioned to receive a head of a screw therein against said bearing surface, and each said protruding portions of said tabs on said base plate having a threaded through bore for receiving a threaded end portion of said screw.

* * * * *